US007573184B2

(12) United States Patent
Ngai et al.

(10) Patent No.: US 7,573,184 B2
(45) Date of Patent: Aug. 11, 2009

(54) HEAT RETAINING SLEEVE

(75) Inventors: Peter Y. Y. Ngai, Alamo, CA (US); John Zhang, Concord, CA (US); Hue Ly, Richmond, CA (US)

(73) Assignee: Acuity Brands, Inc., Atlanta, GA (US)

( * ) Notice: Subject to any disclaimer, the term of this patent is extended or adjusted under 35 U.S.C. 154(b) by 188 days.

(21) Appl. No.: 11/173,795

(22) Filed: Jun. 30, 2005

(65) Prior Publication Data

US 2006/0055293 A1 Mar. 16, 2006

Related U.S. Application Data

(60) Provisional application No. 60/584,614, filed on Jun. 30, 2004.

(51) Int. Cl.
*H01J 1/62* (2006.01)

(52) U.S. Cl. ..... 313/25; 313/493; 313/634

(58) Field of Classification Search ..... 313/25, 313/493, 634, 26, 242, 238
See application file for complete search history.

(56) References Cited

U.S. PATENT DOCUMENTS 6,078,136 A * 6/2000 Sica ..... 313/493

OTHER PUBLICATIONS

U.S. Appl. No. 11/004,481, filed Dec. 3, 2004, Dorogi et al.

* cited by examiner

*Primary Examiner*—Joseph L Williams
(74) *Attorney, Agent, or Firm*—Donald L. Beeson; Beeson Skinner Beverly, LLP

(57) ABSTRACT

A heat retaining sleeve for raising the cold spot temperature of a fluorescent lamp is comprised of a base end, a distal end, and a sleeve body sized and shaped to fit over the end of a fluorescent lamp or lamps where the lamp's cold spot exists. The sleeve creates a heat retaining air gap between the inner surface of the sleeve body and the lamp end or ends with the cold spot, and has sufficient length to so that, when fitted over the lamp end or ends, the cold spot temperature is elevated to a temperature that increase the lumen output of the fitted fluorescent lamp or lamps.

29 Claims, 8 Drawing Sheets

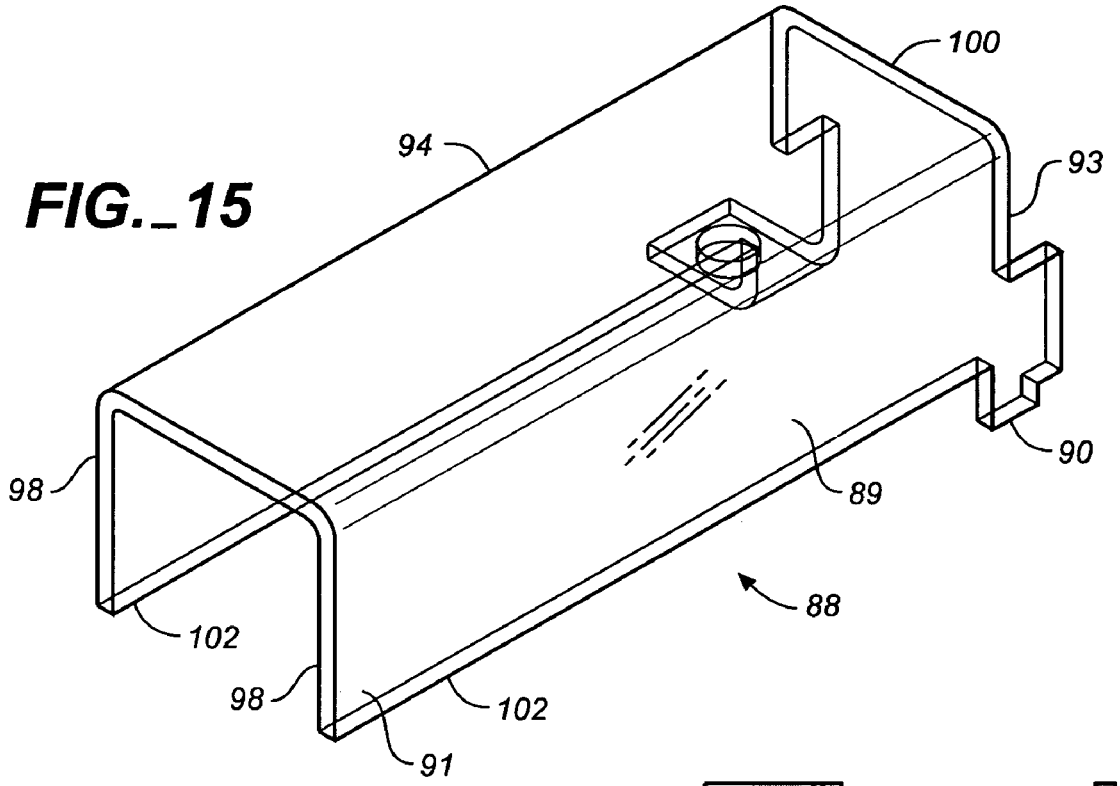
FIG._15
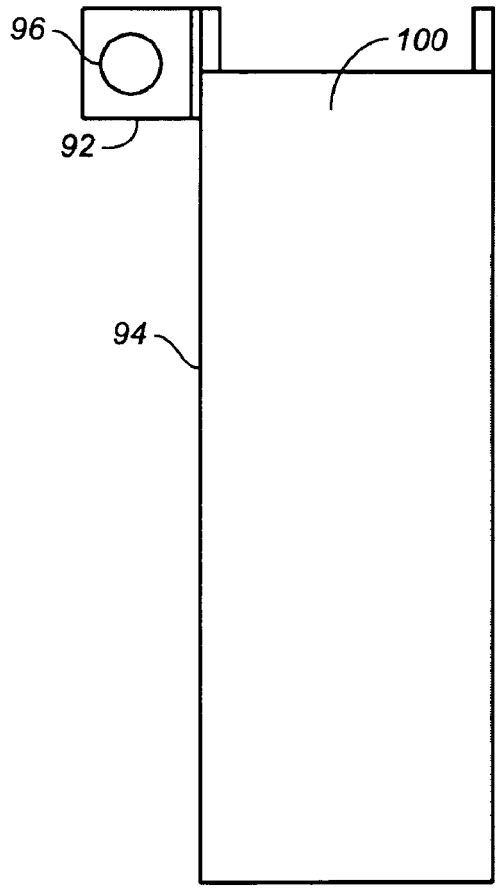
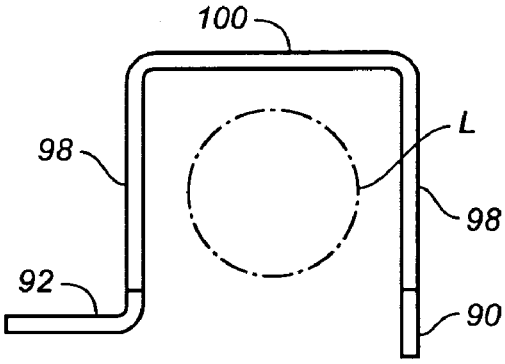
FIG._17
FIG._16

HEAT RETAINING SLEEVE

CROSS-REFERENCE TO RELATED APPLICATIONS

This application claims the benefit of U.S. Provisional Application No. 60/584,614, filed Jun. 30, 2004.

BACKGROUND OF THE INVENTION

This application relates to a heat-retaining sleeve for a fluorescent lamp for increasing the temperature of the 'cold spot' of the lamp to optimize the lumen output of the lamp.

All fluorescent lamps have an optimum temperature at which maximum lumen output is produced. The lumen output of fluorescent lamps is related to two characteristic temperatures: the ambient temperature, and the "cold spot" temperature. The ambient temperature is the temperature of the air immediately surrounding the lamp. The "cold spot" temperature is the temperature of the lamp itself at its coldest point, generally situated behind the electrode at the brand-stamp end of the lamp. Maximum lumen output is experienced when either the ambient temperature or the cold spot temperature reaches an optimum temperature. Certain linear fluorescent lamps, such as T-5 and T-5 HO lamps, operate at a relatively high optimum lighting temperature. (Hereafter, reference to a "T-5" lamp shall be understood to include a T-5 HO lamp) An ambient temperature of 35 degrees Celsius or a cold spot temperature of 43 to 46 degrees Celsius corresponds to conditions in the T-5 lamp which result in maximum lumen output.

Lamps in indirect lighting fixtures tend to operate at cooler temperatures than those in direct lighting fixtures. In the case of T-8 lamps, the operating temperature is near optimum. However, T-5 lamps in indirect lighting fixtures operate at a temperature which is cooler than the optimum and therefore do not produce maximum lumen output. Preliminary tests indicate that the lumen output of a T-5 lamp operating in an indirect lighting fixture is roughly ten percent lower than the optimum lumen output.

One attempt has been made to solve this problem by increasing the temperature of the cold spot of the lamp. Seeking to elevate the temperature of the lamp's cold spot, which is located at one end of the lamp, a cylindrical sleeve such as graphically illustrated in FIG. 1 has been devised to fit over that lamp end. As seen in FIG. 1, this sleeve includes an end portion having a reduced inner diameter that fits snugly onto the metal end cap of the lamp, and a relatively short extended portion that surrounds a short section of the lamp's glass envelope adjacent the lamp's cold spot to form a cylindrical air gap between the sleeve and lamp. This sleeve has proved to be ineffective. It conducts heat away from the lamp through the end cap and is too short to direct enough of the lamp's heat to the lamp's cold spot to appreciably elevate temperature. This type of sleeve has also proved to be difficult to install in an indirect lighting fixture due to crowding of the sleeve by the bottom reflector plate.

A need therefore exists for a solution that enables a linear fluorescent lamp, and particularly a T-5 lamp, in an indirect light fixture to operate at an optimum or near optimum temperature for increasing the lumen output of the lamp. A need also exists for a device that can be easily installed in indirect lighting fixtures for increasing the lumen output of the fluorescent lamps of T-5 fluorescent lighting fixtures.

SUMMARY OF THE INVENTION

Briefly, the invention is a heat retaining sleeve used in connection with at least one linear fluorescent lamp, and particularly a T5 fluorescent lamp, having metal end caps, a lamp body in the form of a glass envelope, a cold spot at one end of the lamp at or in close proximity to one of the lamp's end caps, and a hot spot in the lamp body inboard of the lamp's cold spot. The sleeve of the invention is comprised of a base end, and a sleeve body which extends from the base end to the distal end and terminates at the distal end. The sleeve body is adapted to fit over the cold spot end of the lamp without any substantial touching of the end cap of the lamp, and preferably without any touching whatsoever. In one aspect of the invention, the sleeve's base end attaches to the fluorescent lamp socket, such as a T5 lamp socket. Suitably, sleeves in accordance with this aspect of the invention can have base ends adapted to fit over and attach to a variety of lamp socket designs. In other aspects of the invention the sleeve is adapted for mounting to the fixture's bottom reflector.

The body of the sleeve of the invention has sufficient length so that the sleeve extends over the end of the lamp where the cold spot is located, and from there over a portion of the lamp body to at least near and preferably beyond the lamp's hot spot inboard the covered cold spot, so that heat generated at the hot spot can be captured by the sleeve. Preferably, the sleeve body, and suitably the entire sleeve, is made of a transparent plastic material, such as a polycarbonate plastic, so that no light is blocked by the sleeve.

In one version of the invention, a sleeve for use with one lamp has a substantially cylindrical inner diameter that is somewhat larger than the outer diameter of the lamp body, such that a cylindrical heat insulating gap is formed between the sleeve body and the lamp body. The section of the sleeve body immediately adjacent the base end covers the metal end cap without any touching of the end cap, thereby preventing the sleeve from conducting heat away from the lamp through the end cap. The extension of the sleeve body over both the cold spot and the hot spot permits the heat insulating gap to pick up some of the heat from the hot spot for warming the cold spot. Such a sleeve can be provided in either a full cylinder embodiment or a partial cylinder embodiment. The full cylinder embodiment is preferred for use in lighting fixtures in which the lamp is not crowded by a reflector plate, such as those found in indirect-direct lighting fixtures. The partial cylinder embodiment is preferred for use in totally indirect lighting fixtures having a bottom reflector plate which tends to crowd the lamp leaving less room for a surrounding sleeve. The partial cylinder embodiment is therefore significantly easier to install in such fixtures.

In a further version of the invention, the one lamp cylindrical or partially cylindrical version of the heat retaining sleeve has a downwardly depending projection at the distal end of the sleeve body that extends towards the lamp body to support the sleeve in concentrically spaced relation to the lamp body.

In still a further version of the partial cylinder embodiment of the invention, the sleeve's partially cylindrical body defines an elongated opening having two longitudinally extending bottom edge portions with longitudinal ribs that extend inwardly towards each other. When installing the sleeve in an indirect lighting fixture having a bottom reflector plate, this opening is downwardly oriented and positioned adjacent the bottom reflector plate. Although the ribs extend substantially the length of the sleeve body, at the base end of the sleeve they are spaced from and not in contact with the metal end cap of the lamp.

The invention also encompasses versions of a heat retaining sleeve in non-cylindrical shapes, and sleeves that cover the cold spot ends of more than one lamp, such as the cold spot ends of two or three side-by-side lamps.

BRIEF DESCRIPTION OF THE DRAWINGS

FIG. 15 is a perspective view of a third embodiment of a heat retaining sleeve according to the invention.

FIG. 16 is a top plan view of the heat retaining sleeve illustrated in FIG. 15.

FIG. 17 is a distal end elevation view of the heat retaining sleeve illustrated in FIG. 15 shown around a representation of a lamp.

DETAILED DESCRIPTION OF THE ILLUSTRATED EMBODIMENT

Figure 3:
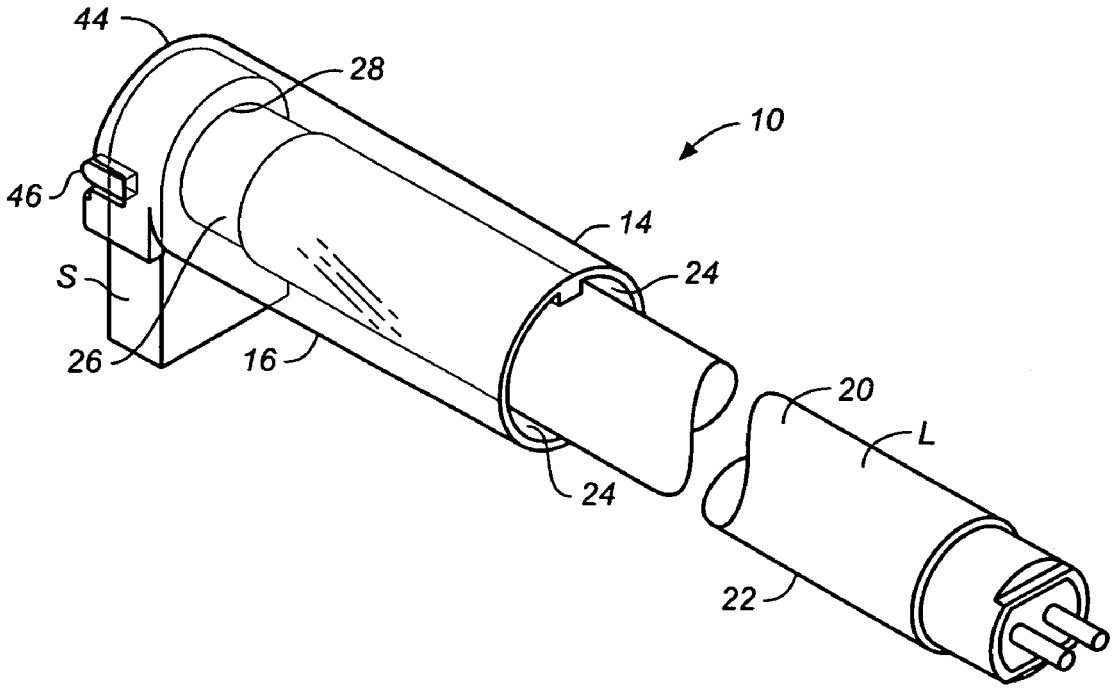
FIG. 3 is a top perspective view of a heat retaining sleeve according to the invention shown mounted over a generic lamp socket and around a lamp installed in the socket.
Figure 4:
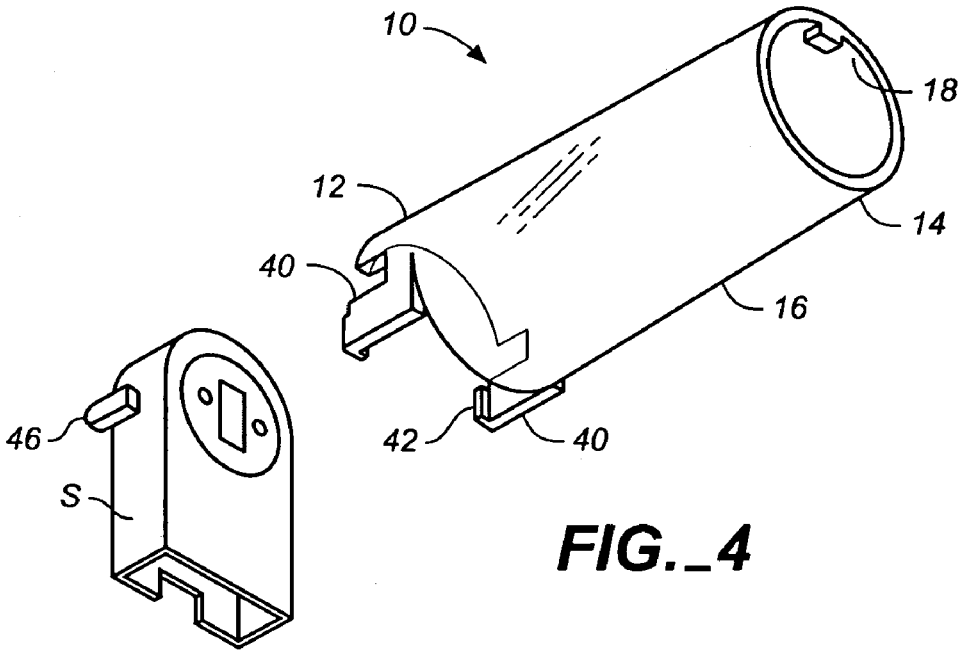
FIG. 4 is a bottom perspective view of the heat retaining sleeve of FIG. 3 shown in exploded relation to the lamp socket.
Figure 5:
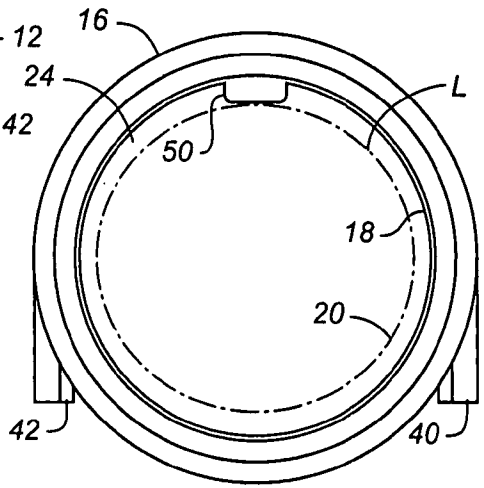
FIG. 5 is an end elevation view of the distal end of the heat retaining sleeve of FIG. 3.
Figure 6:
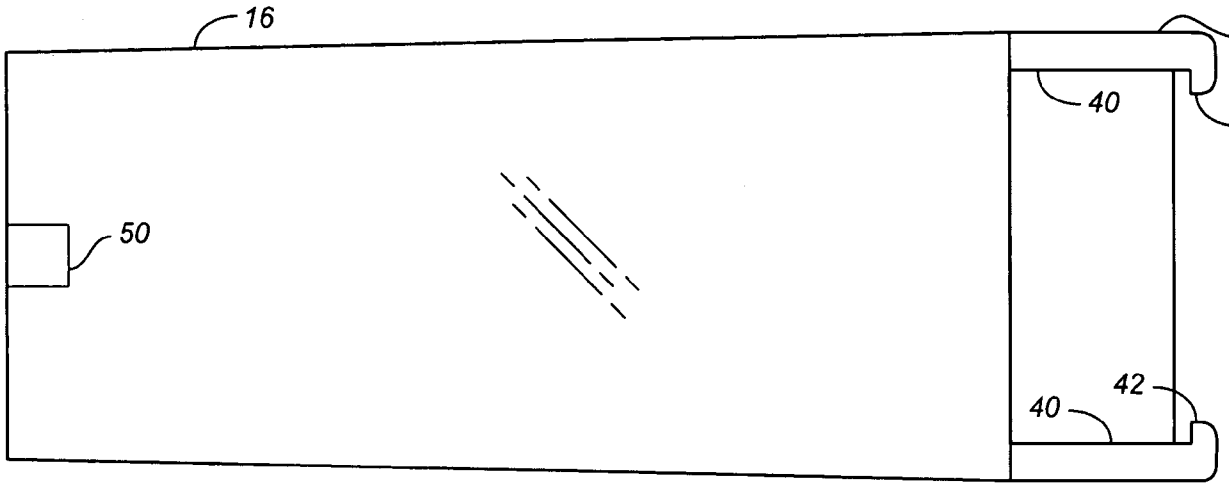
FIG. 6 is a bottom plan view of the heat retaining sleeve of FIG. 3.
Figure 7:
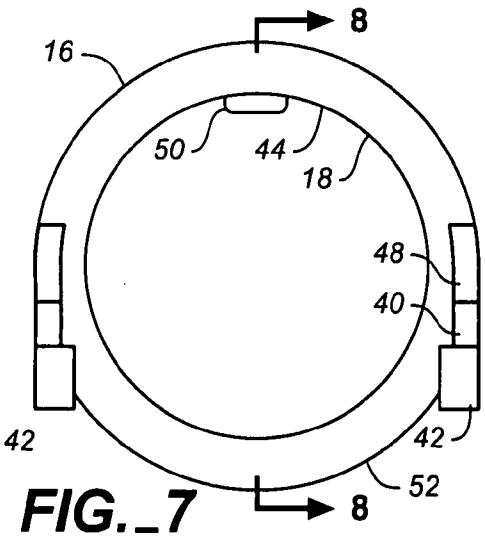
FIG. 7 is an end elevation view thereof showing the base end of the heat retaining sleeve of FIG. 3.
Figure 8:
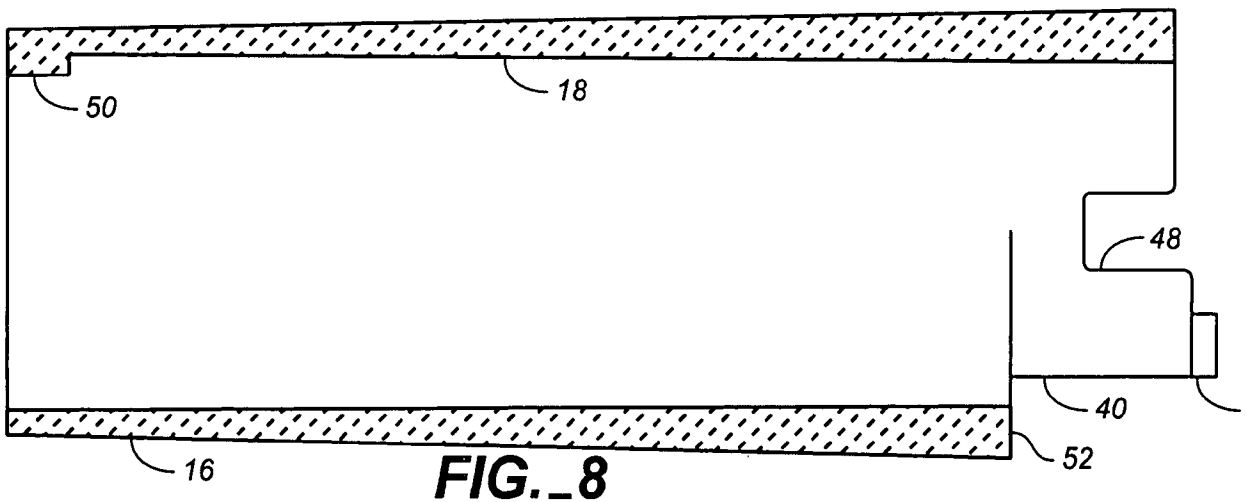
FIG. 8 is a sectional view of the heat retaining sleeve taken along lines 8-8 indicated in FIG. 7.
Figure 9:
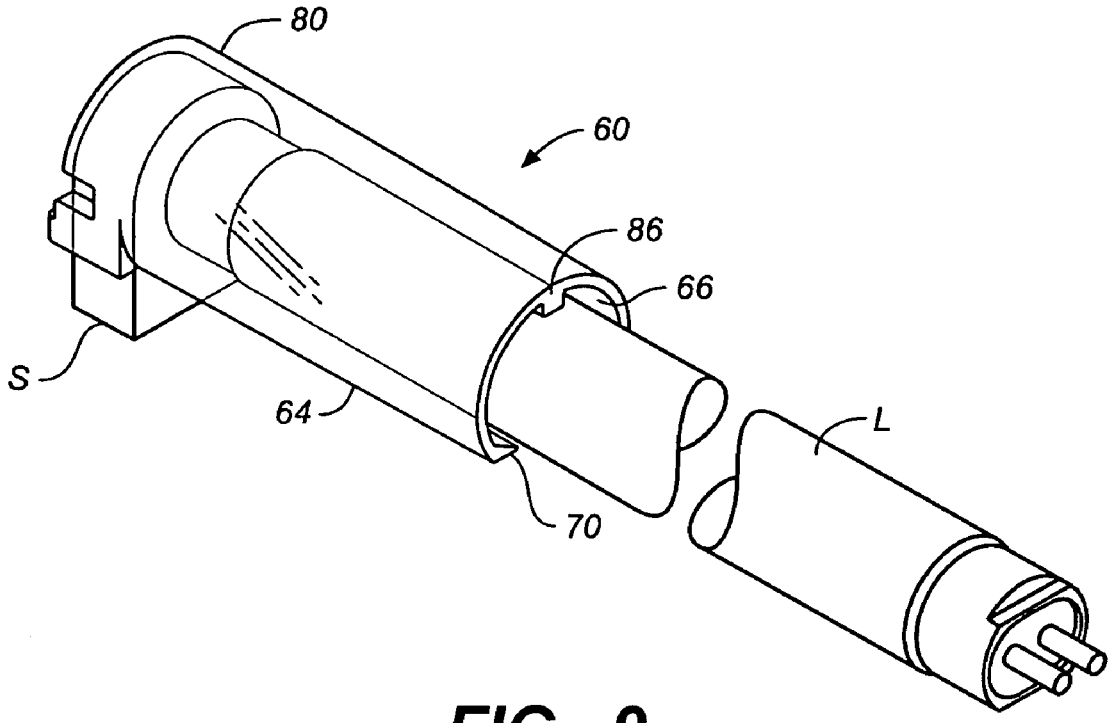
FIG. 9 is a top perspective view of a second embodiment heat retaining sleeve according to the invention shown mounted over a generic lamp socket and around a lamp installed in the socket.
Figure 10:
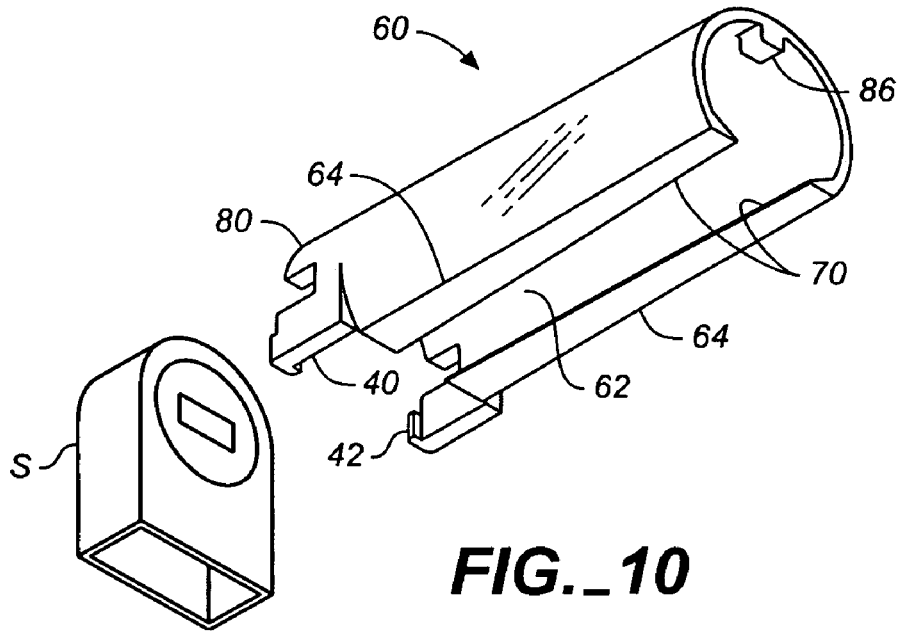
FIG. 10 is a bottom perspective view of the heat retaining sleeve of FIG. 9 shown in exploded relation to the lamp socket.

With reference to the accompanying illustrations, a heat retaining sleeve according to the invention, generally indicated at 10 in FIGS. 3 and 4, comprises a base end 12, and a sleeve body 16 terminating at a distal end 14. In general, the base end 12 attaches to a T5 lamp socket S, and the sleeve body 16 extends from the base end 12 over a T5 lamp L, one end of which is installed in the socket S. The sleeve body 16 is preferably constructed of a transparent polycarbonate such as Lexan® 940A polycarbonate manufactured by General Electric Company, but could be constructed of various transparent, translucent, or even opaque materials.

Figure 1:
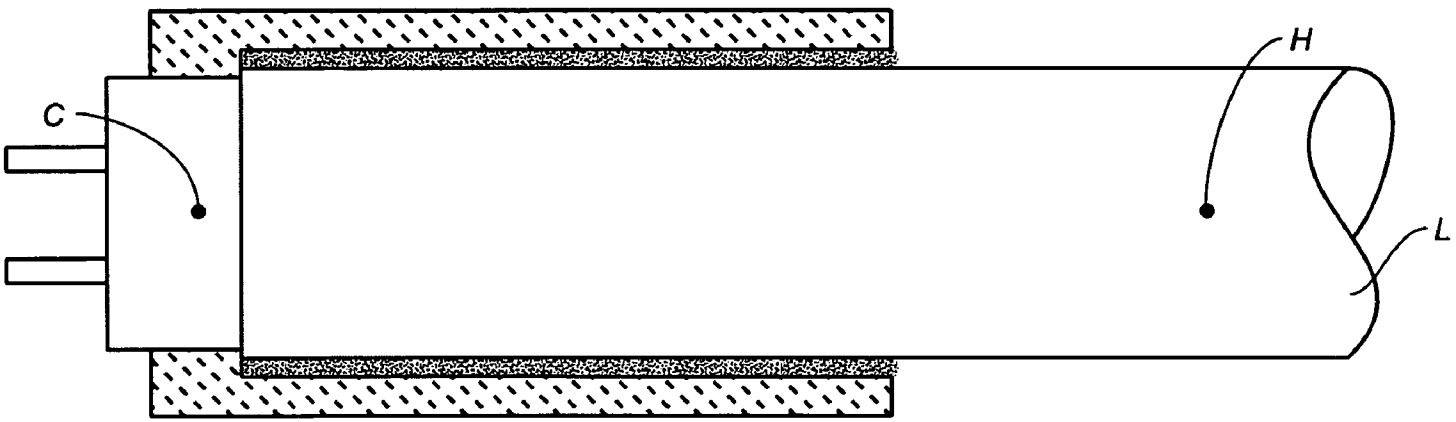
FIG. 1 (PRIOR ART)
FIG. 1 is a top plan view of a prior art heat retaining sleeve.
Figure 2:
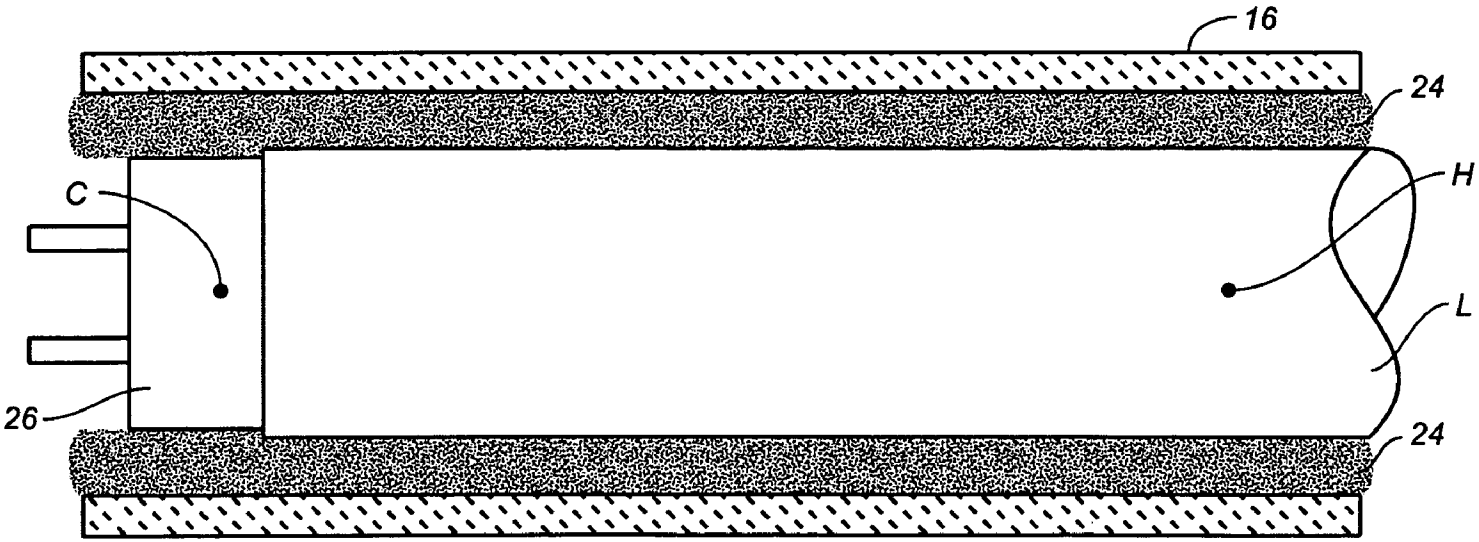
FIG. 2 is a top plan view of a schematic representation of a heat retaining sleeve extending over the cold spot and the hot spot of a lamp.

With particular reference now to FIGS. 3-8, the sleeve body 16 has a cylindrical inner surface 18 having a diameter larger than the diameter of the outer surface 20 of the lamp body 22, such that a cylindrical heat retaining gap 24 is formed around the lamp body 22. FIG. 2 illustrates the general concept that the heat retaining gap should extend over both the cold spot C and the hot spot H of the lamp L while the sleeve body should avoid touching the lamp including the lamp base. According to the invention therefore, the sleeve body 16 extends from the base end 12 over the metal end cap 26 of the lamp L, where the cold spot C is located, and over the lamp body 22 a sufficient distance to extend over and envelop the hot spot H. The heat retaining gap 24 therefore extends from a point before the cold spot C at least to if not beyond the hot spot H. Consequently, heat captured from the hot spot H transfers by convection through the heat retaining gap 24 to the cold spot C. Through experimentation it has been determined that a heat retaining gap larger than 0.032 inches is required for effective convection of heat from the hot spot H to the cold spot C, and that the heat gap should preferably measure between approximately 0.063 and 0.083 inches. Typically the hot spot H on a horizontally mounted T-5 lamp will be located approximately 1-⅝ inches from the terminal end 28 of the end cap. Accordingly, the sleeve body 16 must extend at least 1-⅝ inches from the terminal end 28 of the end cap 26 over the end cap 26 and the lamp body 22 to capture heat from the hot spot H. Applicants have determined that a sleeve body 16 which extends from the terminal end 28 of the end cap 26 for two to two and one-half inches is effective to convey sufficient heat from the hot spot H to the cold spot C to raise the temperature of the cold spot C to the optimum operating range between 43° and 46° C. Preferably, the sleeve body 16 extends from the base portion 12, at a point coinciding with the terminal end 28 of the end cap 26, approximately 2.049 inches. Inclusive of the base end 12, the entire sleeve 10 preferably has a length of approximately 2.38 inches, but the sleeve could be as long as 2.9 inches.

Typically the outer diameter of the end cap 26 is no greater than the diameter of the outer surface 20 of the lamp body 22. The end cap 26 of a properly installed fluorescent lamp is normally disposed immediately adjacent to the lamp socket S. Since the base end 12 of the heat retaining sleeve 10 is secured to the lamp socket S, the heat retaining sleeve 10 need not and does not attach to the end cap 26 in order to be held in disposition around the lamp body 22. The inner surface 18 of the sleeve body 16 in the illustrated embodiment is therefore annularly spaced from the metal end cap 26 in like manner as it is spaced from the lamp body 22. This has the distinct advantage that any heat generated by the metal end cap 26 is not conducted into the sleeve body 16 and away from the lamp L, but is retained in the heat retaining gap 24 where it is used to warm the cold spot C.

The base end 12 is constructed to permit it to be installed on several different fluorescent lamp socket designs. A pair of semi-rigid arms 40 are provided for extending along the sides of a T-5 lamp socket S. Inwardly extending protrusions 42 on the ends of the arms 40 reach behind the lamp socket S and prevent the heat retaining sleeve 10 from slipping forward away from the socket. The semicircular top part 44 of the base end 12 fits over the arced top of the lamp socket. Finally, to accommodate lamp sockets of the type having side-mounted clip arms 46 as shown in FIGS. 3 and 4, a slot 48 is provided on each side of the base end which cooperates with the clip arms 46.

The sleeve body 16, as mentioned above, extends from the base end 12 over the lamp body 22. A first embodiment of the sleeve body 16 as seen in FIGS. 3-8 is a full cylinder. The full cylinder embodiment is appropriate for use in a direct-indirect lighting fixtures where the lamp body is not crowded by a bottom reflector surface. The full cylinder embodiment completely encircles the lamp body 22 to form a cylindrical heat retaining gap 24 between the inner surface 18 of the sleeve body 16 and the lamp body 22. A downwardly depending projection 50 on the upper part of the distal end 14 of the sleeve body 16 supports the length of the sleeve body over and in concentric alignment with the lamp body in position to form the heat retaining gap 24. This works well in fixtures in which the lamp sockets are upwardly oriented. It will be appreciated that in lighting fixtures in which the lamp sockets are downwardly directed, the projection 50 will be disposed on the opposite side of the sleeve. Those of skill in the art will also understand that alternate embodiments may include a plurality of projections arranged annularly about the distal end of the sleeve body or along longitudinally distributed points on the inner surface 18 of the sleeve body 16 in order to maintain the sleeve body 16 in spaced disposition to the lamp body 22.

An arced rear face 52 of the sleeve body adjacent the base end 12 is spaced apart from the inwardly extending protrusions 42 of the arms 40 a distance to accommodate a lamp socket. The rear face 52 is immediately juxtaposed to a lamp socket S on which the base end 12 is installed and prevents the heat retaining sleeve 10 from slipping backwards off of the socket. Hence, a heat retaining sleeve 10 installed on an upwardly oriented lamp socket will be prevented from slipping forward by the inwardly extending protrusions 42 on the side arms 40 and will be prevented from slipping backwards by the rear face 52 of the sleeve body 16. The side arms 40, extending protrusions 42, and rear face 52 of the sleeve body 16 also cooperate to prevent the sleeve body from pivoting horizontally away from its concentric alignment with the lamp body 22. The sleeve body 16 is thus maintained in spaced relation to the lamp body forming a continuous generally cylindrical heat retaining gap extending from the base end 12 to the distal end 14 of the sleeve.

Figure 11:
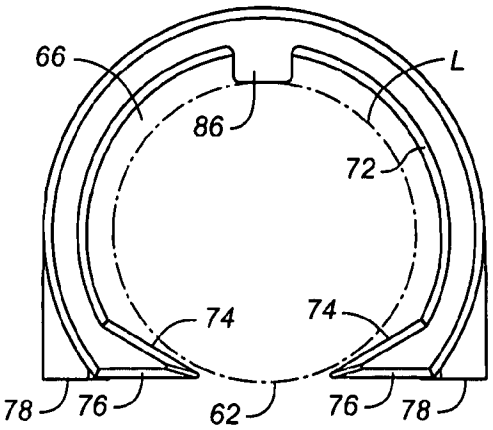
FIG. 11 is an end elevation view thereof showing the distal end of the heat retaining sleeve of FIG. 9.
Figure 12:
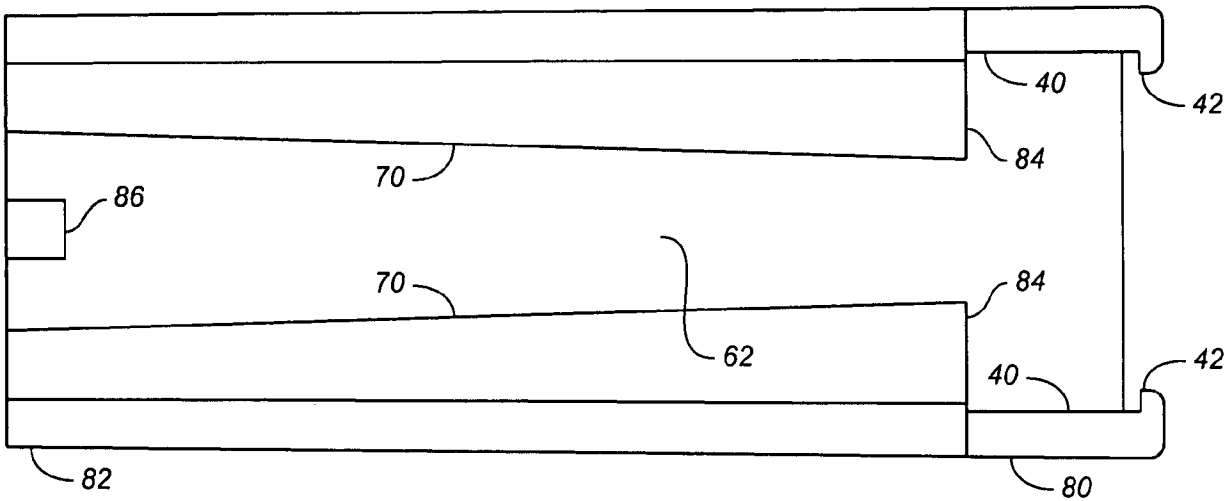
FIG. 12 is a bottom plan view of the heat retaining sleeve of FIG. 9.
Figure 13:
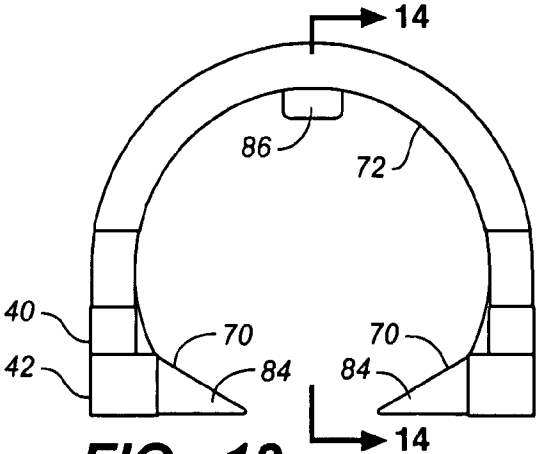
FIG. 13 is an end elevation view thereof showing the base end of the heat retaining sleeve of FIG. 9.

A second embodiment of the sleeve comprises a partial cylinder sleeve body 60 seen in FIGS. 9-14. The partial cylinder 60 is preferably for use in indirect lighting fixtures characterized by a bottom reflector plate (not illustrated) which tends to crowd the lamp L leaving insufficient room for installation of the full cylinder embodiment of the sleeve body shown in FIGS. 3-8. The partial cylinder sleeve body 60 includes an elongated longitudinal bottom opening 62 defined by substantially parallel edge portions 64 extending longitudinally along the bottom of the sleeve body 60 adjacent the fixture's bottom reflector plate (not shown). The partial cylinder 60 advantageously cooperates with the bottom reflector plate to form a substantially cylindrical heat retaining gap 66 around most of the lamp body except for a relatively small portion at the bottom. Along each edge portion 64 of the opening is an inwardly extending rib 70 traversing the length of the opening 62. Each rib extends from the inner surface 72 of the sleeve body generally towards the other rib and has an angular profile which reduces to a point at its innermost extension. The ribs approach very nearly to, but do not touch, the lamp. This serves the dual purpose of providing an upper rib surface 74 that generally defines the lowermost dimension of the heat retaining gap 66 and avoids wicking heat away from the lamp through the ribs into the sleeve. Similarly, the ribs 70 do not come into contact with the metal end cap 26 of the lamp L to prevent heat from being conducted away from the metal end cap 26 through the sleeve 60. Referring to FIGS. 11 and 12, the lower surfaces 76 of the ribs and the bottom surface 78 of the base end mutually terminate generally in a horizontal plane thereby providing the sleeve 60 with a truncated lower profile permitting its efficient installation in indirect lighting fixtures.

Figure 14:
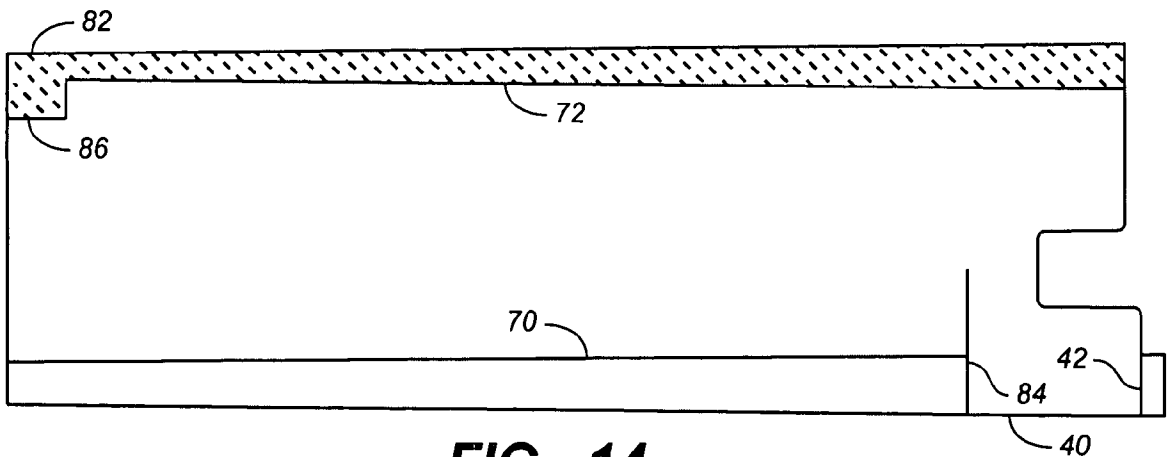
FIG. 14 is a sectional view of the heat retaining sleeve taken along lines 14-14 indicated in FIG. 13.

It is anticipated that a heat retaining sleeve according to the invention will be manufactured in a mold. Referring to FIG. 12, it is seen that the transverse dimension of the ribs 70 is greater adjacent the base end 80 of the sleeve 60 than their transverse dimension adjacent the distal end 82 of the sleeve. Referring to FIG. 14, the wall thickness of the sleeve 60 is similarly greater adjacent the base end 80 than adjacent the distal end 82 of the sleeve. The increasing thickness of the sleeve wall and ribs creates a draft angle that facilitates ejection of a newly molded sleeve from the mold during the manufacturing process.

Each of the ribs has a back face 84 adjacent the base end 80 disposed in spaced opposition to the inwardly extending protrusions 42 on the side arms 40. The back faces 84 serve a like purpose as the rear face 52 of the full cylinder sleeve body 16 in that they prevent the heat retaining sleeve 60 from slipping backwards in relation to a lamp socket S on which the sleeve 10 is installed. Similarly, projection 86 depends downwardly from the upper part of the inner surface 72 of the sleeve body 60 to support the sleeve body in concentric alignment with the lamp body L. The side arms 40, extending protrusions 42, and back faces 78 similarly cooperated to prevent the sleeve body 60 from pivoting horizontally off concentric alignment with the sleeve body 60.

A third embodiment of a heat retaining sleeve according to the invention is generally indicated by numeral 88 in FIGS. 15-17. In this embodiment, the sleeve, which covers a single lamp L in an indirect lighting fixture and is of a generally square shape, has a sleeve body 89 with a distal end 91 that extends a sufficient distance to reach the hot spot of the lamp. A base end 93 of the sleeve has a downwardly depending projection 90 for fitting into a cooperating aperture (not shown) in the lighting fixture. A tab 92, which extends laterally from the base end, has a hole 96 for accepting a threaded fastener for securing the sleeve 88 to the lighting fixture. The sleeve 88 includes generally parallel side walls 98 and a top wall 100. In alternate embodiments, all or portions of the lengths of the bottom edges 102 of the side walls 98 may be higher to accommodate the elements of the lighting fixture in which the sleeve 88 is mounted, particularly bottom reflector plates which may angle up from the bottom of the fixture.

Figure 18:
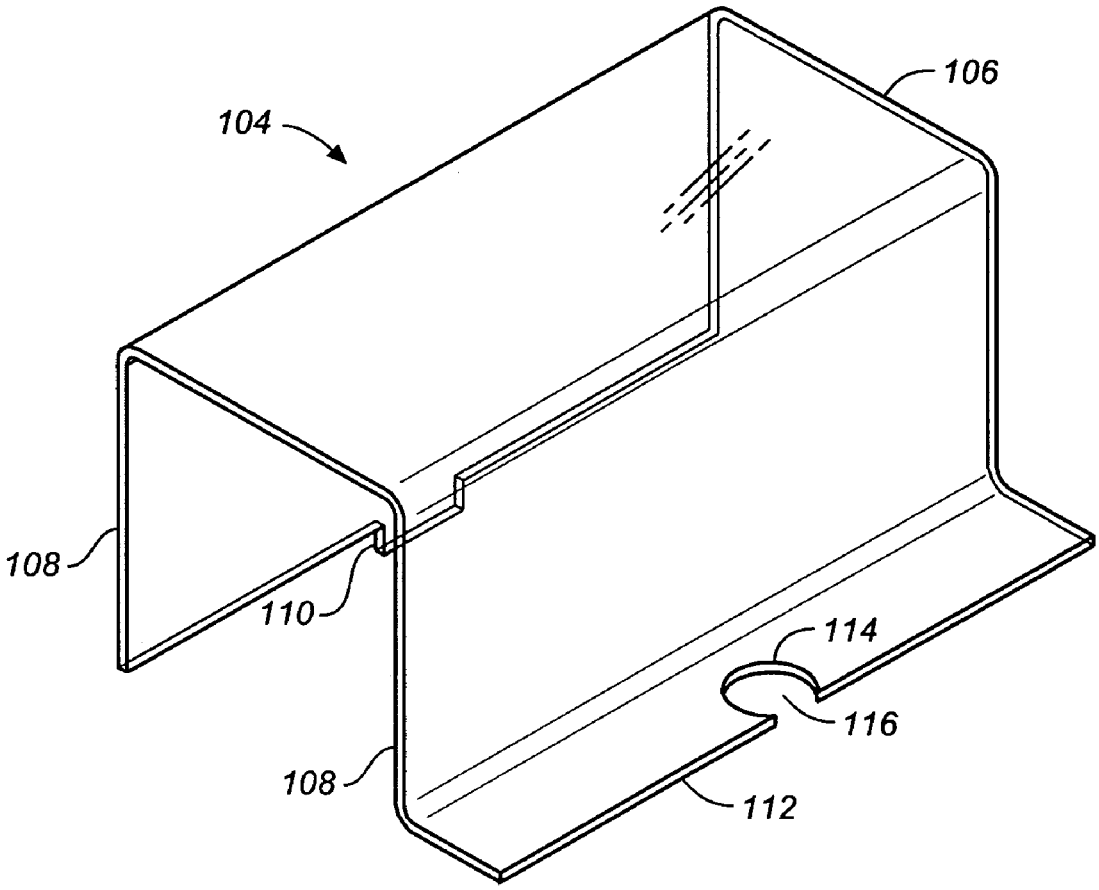
FIG. 18 is a top perspective view of a fourth embodiment of a heat retaining sleeve according to the invention.
Figure 19:
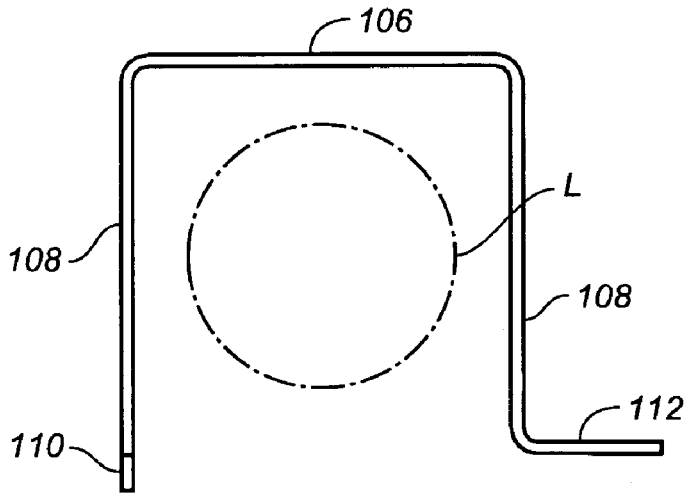
FIG. 19 is a distal end elevation view of the heat retaining sleeve illustrated in FIG. 18 shown around a representation of a lamp.

A fourth embodiment of a heat retaining sleeve according to the invention is generally indicated at 104 in FIGS. 18 and 19. Preferably, for installation on a single lamp L in an indirect lighting fixture in which space behind the lamp socket for mounting the sleeve is limited, sleeve 104 has a generally orthogonal profile comprising a top wall 106 and generally parallel side walls 108. A projection 110 depends downwardly from one of the side walls 108 for fitting into a cooperating aperture (not illustrated) in the lighting fixture. A lip 112 extends laterally from the opposite side wall 108 and has a hole 114 for accepting a threaded fastener for securing the sleeve 104 to the lighting fixture. The hole 114 is not fully enclosed such that a side gap 116 communicates with and provides side access to the hole 114. The side gap 116 makes installation of the sleeve 104 easier because a threaded fastener can first be partially mounted in the lighting fixture wall before slipping the lip 112 between the head of the fastener and the fixture wall with the hole in alignment with the fastener in preparation for tightening up the fastener. Installation of sleeve 104 may be in combination with a cooperating bottom plate (not shown) to enclose the lamp L from below.

Figure 20:
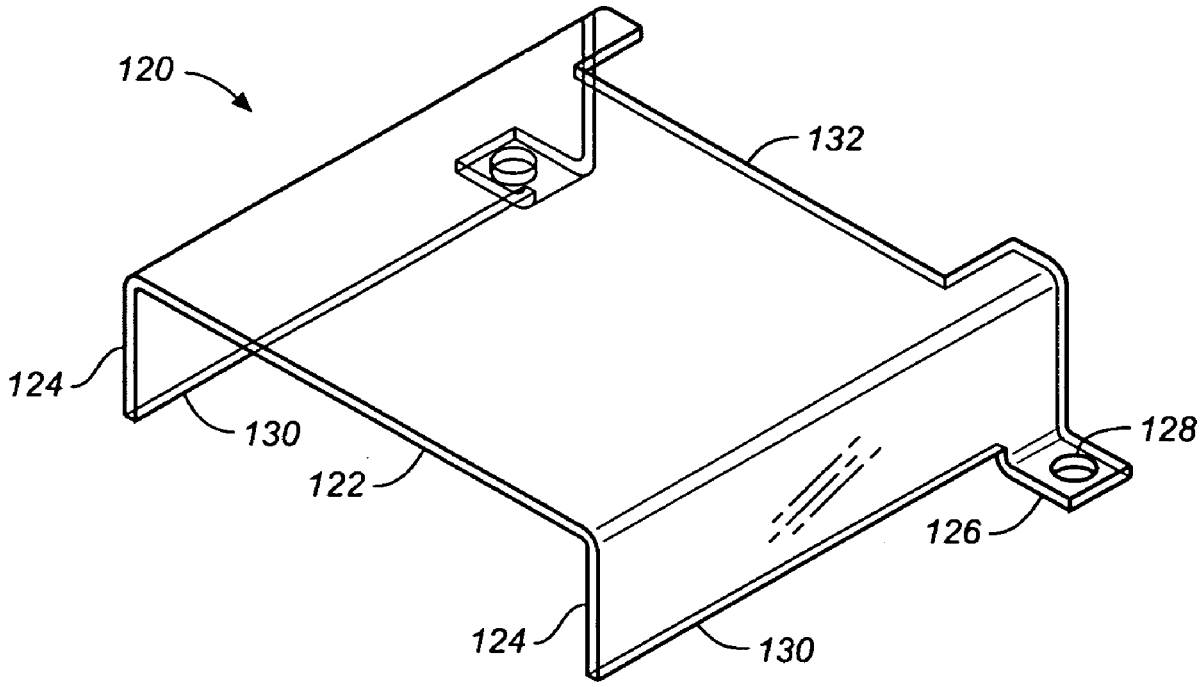
FIG. 20 is a top perspective view of a fifth embodiment of a heat retaining sleeve according to the invention.
Figure 21:
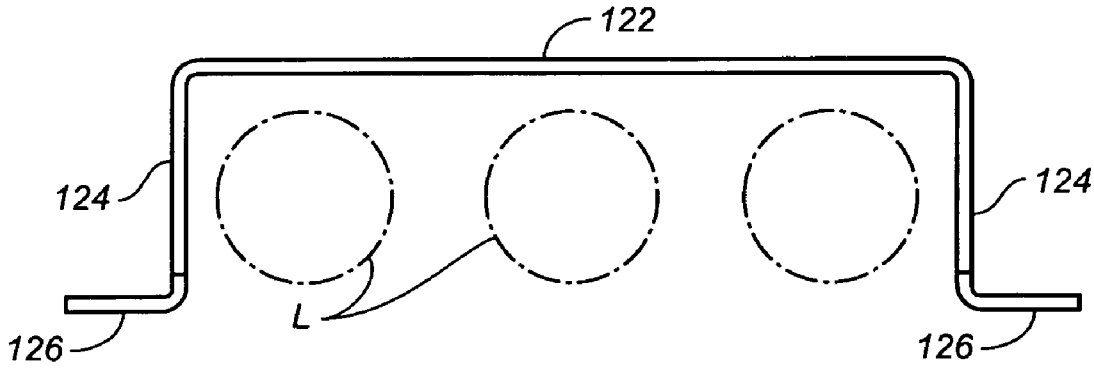
FIG. 21 is a distal end elevation view of the heat retaining sleeve illustrated in FIG. 20 shown around a representation of three adjacent lamps.

A fifth embodiment of a heat retaining sleeve according to the invention is generally indicated by the numeral 120 in FIGS. 20 and 21. Preferably, for installation in a lighting fixture featuring two or more side-by-side lamps (three are illustrated in FIG. 21), sleeve 120 has a sleeve body of a generally rectangular shape comprised of a relatively broad top wall 122 and generally parallel side walls 124. A tab 126 extends laterally from the each side wall 124 and has a hole 128 for accepting a threaded fastener for securing the sleeve 120 to the lighting fixture. Similarly to the third embodiment described above, in alternate embodiments, all or portions of the lengths of the bottom edges 130 of the side walls 124 may be higher to accommodate the elements of the lighting fixture in which the sleeve 120 is mounted. A transverse gap 132 is provided at the rear side of the top wall 122. In alternate embodiments, the width and depth of the gap 132 may vary to release different amounts of heat from the underlying lamps. Also, because this version of the sleeve captures relatively more heat from the lamps, the single lamp embodiments of the invention, the length of the sleeve should be somewhat shorter in order to maintain an optimum temperature and particularly short of covering the hot spots of the covered lamps.

There have thus been described and illustrated certain preferred embodiments of a heat retaining sleeve according to the invention. Although the present invention has been described and illustrated in detail, it is clearly understood that the same is by way of illustration and example only and is not to be taken by way of limitation, the spirit and scope of the present invention being limited only by the terms of the appended claims and their legal equivalents.

We claim:

1. A heat retaining sleeve for at least one linear fluorescent lamp having a lamp body and lamp ends, wherein a cold spot exists at one of the lamp ends and a hot spot exists in the lamp body inboard of said cold spot, said heat retaining sleeve comprising a base end, and a sleeve body extending from said base end and terminating at a distal end, said sleeve body having an inner surface and being sized and shaped to fit over and cover the lamp end of the at least one fluorescent lamp where the cold spot exists without substantial touching of the lamp end, and being sized and shaped to create a heat retaining air gap between the inner surface of said sleeve body and the lamp end of the at least one fluorescent lamp where the cold spot exits wherein the air gap extends over the lamp's cold spot, said sleeve body being short enough so that, when the sleeve is fitted over the lamp end where the cold spot exists, the distal end of said sleeve body does not extend substantially beyond the hot spot of the at least one fluorescent lamp which is inboard said cold spot, yet is long enough so that, when the sleeve is fitted over such lamp end, the cold spot of the at least one fluorescent lamp is elevated to a temperature that increases the lumen output of the at least one fluorescent lamp.

2. The heat retaining sleeve of claim 1 wherein said sleeve body is fabricated of a transparent material.

3. The heat retaining sleeve of claim 2 wherein said transparent material is a polycorbonate.

4. The heat retaining sleeve of claim 1 wherein said sleeve body is generally cylindrical for at least partially surrounding the end of a cylindrical linear fluorescent lamp.

5. The heat retaining sleeve of claim 4 further comprising means for maintaining the inner surface of said sleeve body in substantial concentric relation with the lamp body of the cylindrical fluorescent lamp.

6. The heat retaining sleeve of claim 1 further comprising at least one projection extending inwardly from the inner surface of said sleeve body for contacting the lamp body of the cylindrical fluorescent lamp so as to maintain said sleeve body in substantial concentric relation with said lamp body.

7. The heat retaining sleeve of claim 1 wherein said sleeve body is a full cylinder that encircles the lamp body and lamp ends.

8. The heat retaining sleeve of claim 1 wherein said sleeve body is a partial cylinder having a top and a bottom and a longitudinal bottom opening defined by substantially parallel edge portions extending longitudinally along the bottom of the sleeve body.

9. The heat retaining sleeve of claim 8 wherein each of said edge portions has an inwardly extending rib.

10. The heat retaining sleeve of claim 9 wherein said inwardly extending ribs of said edge portions have a transverse dimension that changes along its length to produce a draft angle between said ribs.

11. The heat retaining sleeve of claim 1 further comprising means for attaching the heat retaining sleeve to a lighting fixture in which the fluorescent lamp is installed such that the sleeve body extends over and creates an air gap around the lamp end where the cold spot exists.

12. The heat retaining sleeve of claim 1 wherein the base end of the heat retaining sleeve is formed to attach to a lamp socket into which the cold spot end of the fluorescent lamp is installed such that the sleeve body extends over and creates an air gap around the lamp end where the cold spot exists.

13. The heat retaining sleeve of claim 1 wherein said sleeve body has a generally square shape formed by a top wall and generally parallel side walls having bottom edges.

14. The heat retaining sleeve of claim 13 wherein means for attaching the heat retaining sleeve to a bottom reflector plate of an indirect lighting fixture are provided along the bottom edges of said sleeve body side walls.

15. The heat retaining sleeve of claim 1 wherein said sleeve body is sized and shaped to fit over the cold spot ends of at least two side-by-side fluorescent lamps.

16. The heat retaining sleeve of claim 15 wherein said sleeve body has a generally rectangular shape formed by a broad top wall and generally parallel side walls having bottom edges.

17. The heat retaining sleeve of claim 16 wherein means for attaching the heat retaining sleeve to a bottom reflector plate of an indirect lighting fixture are provided along the bottom edges of said sleeve body side walls.

18. The heat retaining sleeve of claim 1 wherein said sleeve body is sized and shaped to fit over the cold spot end of a fluorescent T5 lamp, and wherein said sleeve body is at least about 1⅝ inches long.

19. The heat retaining sleeve of claim 18 wherein said sleeve body is between about 2 and 2½ inches long.

20. The heat retaining sleeve of claim 1 wherein the length of said sleeve body is no greater than about 2½ inches.

21. A heat retaining sleeve for at least one T5 fluorescent lamp having a lamp body and lamp ends, wherein a cold spot exists at one of the lamp ends and a hot spot exists in the lamp body inboard of said cold spot, said heat retaining sleeve comprising a base end, a sleeve body extending from said base end and terminating at a distal end, and being sized and shaped to fit over and cover the lamp end of the at least one fluorescent T5 lamp where the cold spot exists without substantial touching of the lamp end, means for attaching the heat retaining sleeve onto a lighting fixture in which a fluorescent T5 lamp is installed such that the sleeve body extends over and creates an air gap around the lamp end of the at least one T5 fluorescent lamp where the cold spot exists, the length of said sleeve body being no greater than about 2½ inches yet having sufficient length so that, when the sleeve is fitted over the lamp end, the cold spot of the at least one fluorescent lamp is elevated to a temperature that increases the lumen output of the at least one fluorescent lamp.

22. The heat retaining sleeve of claim 21 wherein said sleeve body is of a sufficient length to elevate the temperature of the cold spot of the T5 lamp to between 43° and 46° C.

23. A heat retaining sleeve for a T5 fluorescent lamp having a cylindrical lamp body and cylindrical lamp ends, wherein a cold spot exists at one of the lamp ends and a hot spot exists in the lamp body inboard of said cold spot, said heat retaining sleeve comprising a base end formed for attachment to a lamp socket into which the cold spot end of the fluorescent lamp is installed, a generally cylindrical sleeve body extending from said base end and terminating at a distal end, and adapted to fit over and cover the lamp end of the T5 lamp where the cold spot exists, said generally cylindrical sleeve body having a length of at least about 1⅝ inches but no greater than about 2½ inches, and having an inside diameter large enough to create, over the entire length to the sleeve body, a heat retaining air gap between the sleeve body and the lamp end of the fluorescent T5 lamp where the cold spot exists when the sleeve is fitted over the lamp's cold spot end.

24. The heat retaining sleeve of claim 23 wherein the inside diameter of said sleeve body is sized to create an air gap between the sleeve body and the end of the T5 lamp of between approximately 0.063 and 0.083 inches.

25. The heat retaining sleeve of claim 23 wherein said sleeve body is a full cylinder that encircles the lamp body and lamp ends.

26. The heat retaining sleeve of claim 23 wherein said sleeve body is a partial cylinder having a top and a bottom and a longitudinal bottom opening defined by substantially parallel edge portions extending longitudinally along the bottom of the sleeve body.

27. The heat retaining sleeve of claim 23 wherein the sleeve body has a generally cylindrical inner surface and wherein at least one projection extends inwardly from the inner surface of said sleeve body for contacting the lamp body of the T5 lamp so as to maintain said sleeve body in substantial concentric relation with said lamp body when the sleeve is fitted over the lamp's cold spot end.

28. The heat retaining sleeve of claim 23 further comprising means for maintaining said sleeve body in substantial concentric relation with the lamp body of the T5 lamp without substantial touching of the T5 lamp.

29. A heat retaining sleeve for a T5 fluorescent lamp having a cylindrical lamp body and cylindrical lamp ends, wherein a cold spot exists at one of the lamp ends and a hot spot exists in the lamp body inboard of said cold spot, said heat retaining sleeve comprising a base end formed for attachment to a lamp socket into which the cold spot end of the fluorescent lamp is installed, a generally cylindrical sleeve body extending from said base end and terminating at a distal end, and adapted to fit over and cover the lamp end of the T5 lamp where the cold spot exists, and means for maintaining said sleeve body in substantial concentric relation with the lamp body of the T5 lamp without substantial touching of the T5 lamp, said generally cylindrical sleeve body having a length of between 2 inches and 2½ inches, and having an inside diameter large enough to create, over the entire length of the sleeve body, a heat retaining air gap of between approximately 0.063 and 0.083 inches between the sleeve body and the lamp end of the fluorescent T5 lamp where the cold spot exists when the sleeve is fitted over the lamp's cold spot end.

* * * * *

UNITED STATES PATENT AND TRADEMARK OFFICE

CERTIFICATE OF CORRECTION

PATENT NO. : 7,573,184 B2
APPLICATION NO. : 11/173795
DATED : August 11, 2009
INVENTOR(S) : Peter Y. Y. Ngai, John Zhang and Hue Ly It is certified that error appears in the above-identified patent and that said Letters Patent is hereby corrected as shown below:

Column 5, line 7, "a" between --in-- and --direct-indirect-- should be deleted.
Column 7, line 12, "the" between --from-- and --each-- should be deleted.
Column 7, line 53, "exits" should read --exists--.
Column 9, line 33, "length to the sleeve" should read --length of the sleeve--.

Signed and Sealed this

Eighth Day of December, 2009

David J. Kappos

David J. Kappos
*Director of the United States Patent and Trademark Office*